United States Patent [19]

Hayashi

[11] Patent Number: 4,569,317

[45] Date of Patent: Feb. 11, 1986

[54] CYLINDER BLOCK OF ENGINE

[75] Inventor: Yoshimasa Hayashi, Kamakura, Japan

[73] Assignee: Nissan Motor Co., Ltd., Yokohama, Japan

[21] Appl. No.: 574,273

[22] Filed: Jan. 26, 1984

Related U.S. Application Data

[62] Division of Ser. No. 309,386, Oct. 7, 1981, Pat. No. 4,452,192.

[30] Foreign Application Priority Data

Oct. 7, 1980 [JP] Japan ..... 55-142991[U]
Oct. 7, 1980 [JP] Japan ..... 55-142989[U]

[51] Int. Cl.[4] ..... F02F 7/00
[52] U.S. Cl. ..... 123/195 R
[58] Field of Search ..... 123/195 R, 195 C, 195 M, 123/41.84

[56] References Cited

U.S. PATENT DOCUMENTS

| | | | |
|---|---|---|---|
| 2,098,451 | 11/1937 | Gilmore | 123/195 R |
| 3,046,954 | 7/1962 | Hoffman et al. | 123/195 H |
| 4,213,440 | 7/1980 | Abe et al. | 123/195 C |
| 4,245,595 | 1/1981 | Abe et al. | 123/195 C |
| 4,280,453 | 7/1981 | List et al. | 123/195 R |

FOREIGN PATENT DOCUMENTS

| | | | |
|---|---|---|---|
| 0054474 | 6/1982 | European Pat. Off. . | |
| 0074120 | 3/1983 | European Pat. Off. . | |
| 2839885 | 4/1979 | Fed. Rep. of Germany . | |
| 0613072 | 11/1960 | Italy | 123/195 R |

OTHER PUBLICATIONS

ATZ Automobiltechnische Zeitschrift, vol. 78, No. 10, Oct. 1976, pp. 423–426, F. Hauk et al., "Der erste serienmassige Reihen-Fuenfzylinder-Ottomotor fuer Personenwagen-eine Entwicklung von Audi Nsu".

Japanese Textbook published Feb. 15, 1979 by Kabushiki Kaisha "Sankaido", (Sankaido Company, Ltd.), Author: The Zenkoku Jidosha Seibi Gakko Renmi, (Japanese Automotive Vehicle Servicing School Federation), Gasoline Engine Construction, pp. 24 and 25.

*Primary Examiner*—Craig R. Feinberg
*Attorney, Agent, or Firm*—Schwartz, Jeffery, Schwaab, Mack, Blumenthal & Evans

[57] ABSTRACT

A cylinder block comprises an upper section having a plurality of engine cylinder bores therein, the upper section having first and second oppositely disposed wall members, and a skirt section having a cavity defining a crankcase for an engine crankshaft, the skirt section having first and second oppositely disposed walls which are integral to and in straight alignment with the first and second wall members of the upper section, respectively, thereby effectively preventing noise radiation from the skirt section and improving the torsional and flexural rigidities of the cylinder block.

5 Claims, 12 Drawing Figures

CYLINDER BLOCK OF ENGINE

This is a division of application Ser. No. 309,386, filed Oct. 7, 1981, now U.S. Pat. No. 4,452,192.

BACKGROUND OF THE INVENTION

1. Field of the Invention

This invention relates generally to an improvement in a cylinder block for an internal combustion engine, and more particularly to a cylinder block construction effective to reduce the vibration-noise radiated therefrom to achieve total engine noise reduction.

2. Description of the Prior Art

In connection with an internal combustion engine for use, for example, in an automotive vehicle, it is well known that a cylinder block to which a cylinder head and an oil pan are secured, has an upper section having therein a plurality of engine cylinder bores, and a lower section or skirt section which is generally bulged outwardly to form thereinside a crankcase for an engine crankshaft. However, such an engine has the problem that the cylinder block thereof vibrates due to fuel combustion pressure and reciprocal engine piston movement. Additionally, this cylinder block vibration causes the skirt section to vibrate, thus radiating a considerable high-level noise from the surface of the skirt section. Such vibrations of the cylinder block are considered to result from a shortage in torsional and flexural rigidities of the cylinder block.

BRIEF SUMMARY OF THE INVENTION

In accordance with the present invention, a cylinder block is composed of an upper section having a plurality of engine cylinder bores therein. The upper section has first and second oppositely disposed wall members. A skirt section is integrally connected to the upper section and has a cavity defining a crankcase for an engine crankshaft. Additionally, the cylinder block is constructed and arranged to prevent the vibration of the skirt section and increase the torsional and flexural rigidities of the cylinder block. This has been achieved, for example, by arranging the first and second walls of the skirt section is straight alignment with the first and second wall members of the upper section, respectively.

With the thus arranged cylinder block the torsional and flexural rigidities of the cylinder block are greatly improved, thereby effectively preventing the upper section and the skirt section from vibrating. Additionally, the surface area of the skirt section is decreased as compared with that of conventional cylinder block. Therefore, noise to be radiated from the cylinder block can be greatly reduced, effectively achieving total engine noise reduction.

BRIEF DESCRIPTION OF THE DRAWINGS

The feature and advantages of the cylinder block according to the present invention will be more clearly appreciated from the following description taken in conjunction with the accompanying drawings in which like reference numerals designate corresponding parts and elements, and in which.

DETAILED DESCRIPTION OF THE INVENTION

Figure 1:
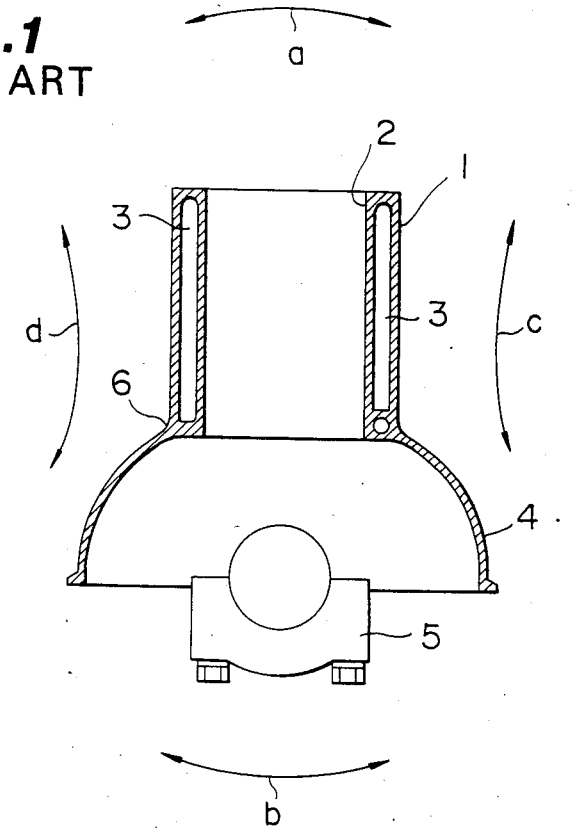
FIG.1 PRIOR ART
FIG. 1 is a vertical cross-section view of a conventional cylinder block of an internal combustion engine.

To facilitate understanding the present invention, a brief reference will be made to a conventional cylinder block, depicted in FIG. 1. Referring to FIG. 1, the cylinder block is composed of opposite upper side walls 1 each of which defines thereinside a water jacket 3 formed around a cylinder row structure including a plurality of cylinder (liner) sections 2. Each cylinder section 2 is formed therein with an engine cylinder bore in which an engine piston will be movably disposed. Additionally, a skirt section 4 defining thereinside a crankcase is integrally connected to the upper side walls 1. The skirt section 4 is bulged so that the inner surface thereof is slightly spaced from and along the envelope of the outer-most loci of a big end of a connecting rod. The reference numeral 5 denotes main bearing caps for rotatably supporting a crankshaft. It is to be noted that the upper side walls are generally parallel with a plane containing axes of the engine cylinder bores, and the connecting section 6 through which the skirt section is integrally connected to each upper side wall 1 is formed into the arcuate shape in cross-section. It will be understood that a cylinder head (not shown) is secured through a gasket onto the top surface of the cylinder block by means of bolts so as to define a combustion chamber within the cylinder bore, and an oil pan is secured to the bottom part of the skirt section 4.

However, with such a conventional cylinder block arrangement, the connecting section 6 between the upper side wall 1 and the skirt section 4 is not sufficient in connection rigidity, and therefore the cylinder block can be twisted in the directions of arrows a and b and bent in the directions of arrows c and d by the vibration caused due to explosion or combustion of air-fuel mixture during engine operation and transmitted to the cylinder block. Such movements of the cylinder block generate considerable vibration noise. Additionally, the skirt section 4 itself also vibrates, thereby generating vibration noise. In other words, with the conventional cylinder block of the above-discussed type, sufficiently high torsional and flexual rigidities cannot be obtained, thus greatly contributing to undesirable total engine noise increase.

Figure 2:
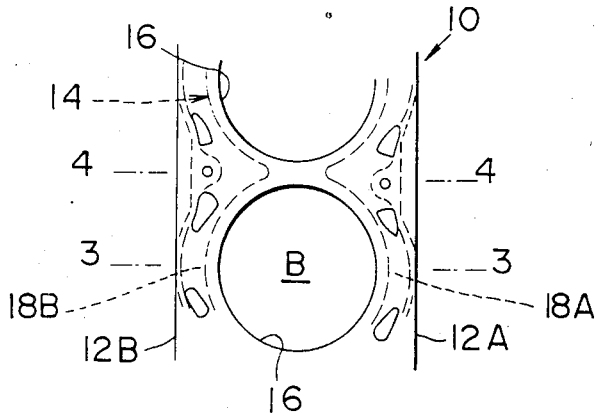
FIG. 2 is a fragmentary plan view of a cylinder block of an internal combustion engine, in accordance with the present invention.
Figure 3:
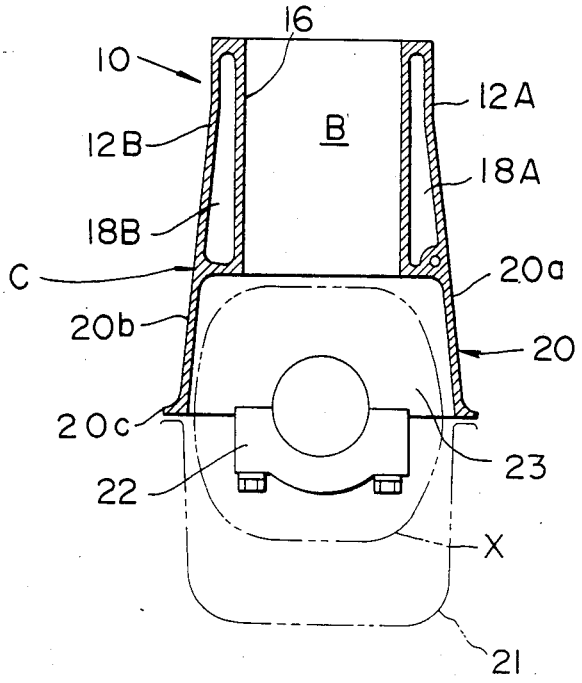
FIG. 3 is a vertical cross-sectional view taken substantially along the line 3—3 of FIG. 2.
Figure 4:
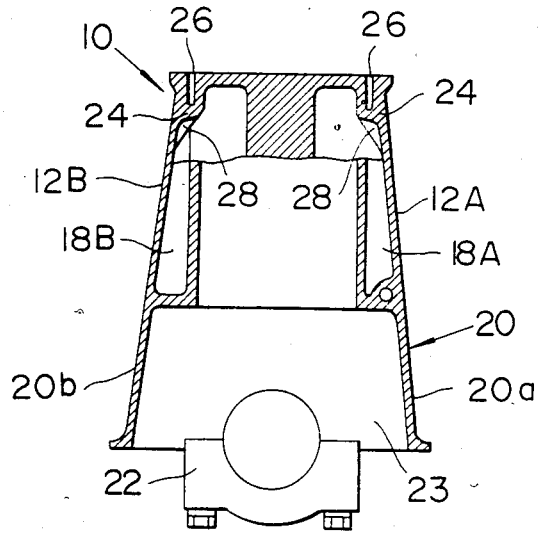
FIG. 4 is a vertical cross-sectional view taken substantially along the line 4—4 of FIG. 2.
Figure 5:
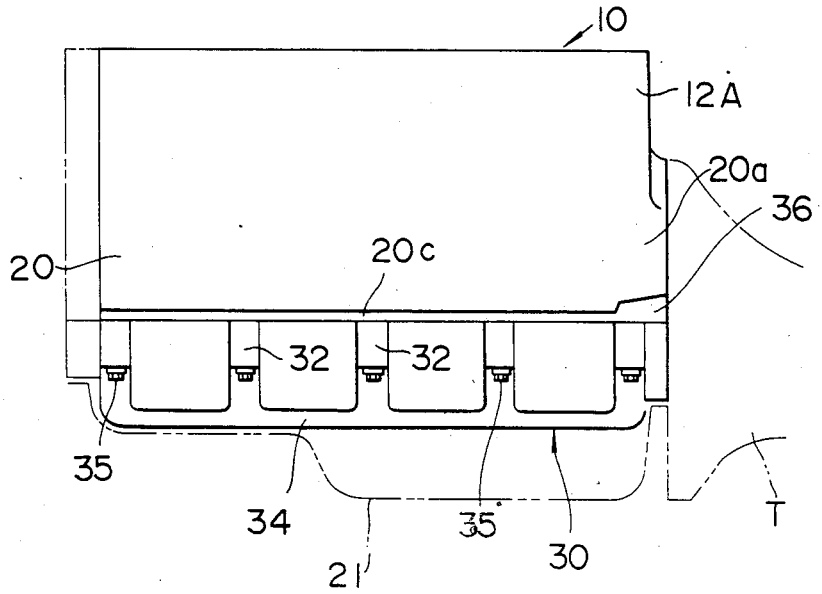
FIG. 5 is a side elevation of another embodiment of the cylinder block equipped with a bearing beam structure, in accordance with the present invention.
Figure 6:
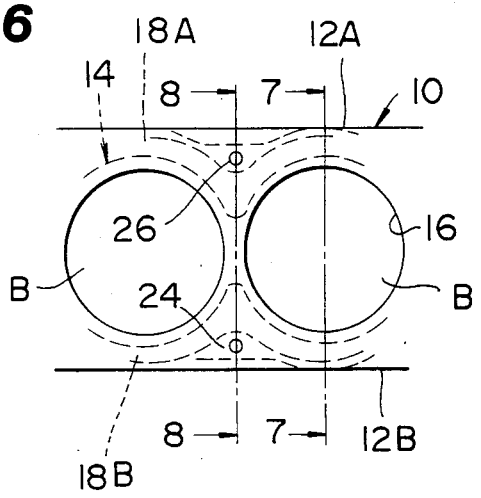
FIG. 6 is a fragmentary plan view of the cylinder block of FIG. 5.

In view of the above description of the conventional cylinder block arrangement, reference is now made to FIGS. 2 to 12, and more specifically to FIGS. 2 to 4, wherein a preferred embodiment of a cylinder block of an automotive internal combustion engine, according to the present invention is illustrated by the reference numeral 10. The cylinder block 10 comprises two upper side walls or water jacket outer walls 12A, 12B which are located opposite to each other and enclose therebetween a cylinder row structure 14. The cylinder row structure 14 has a plurality of cylinder (liner) sections 16 each of which is formed therein with an engine cylinder bore B within which an engine piston will be movably disposed. The plurality of cylinder sections 16 are integrally connected with each other. A water jacket 18A is formed between the water jacket outer wall 12A and the cylinder row structure 14, and another water jacket 18B is formed between the water jacket outer wall 12B and the cylinder row structure 16. An engine coolant will flow through the water jackets 18A, 18B to cool each engine cylinder section 16.

A skirt section 20 of the cylinder block 10 has two oppositely disposed counterparts or walls 20*a*, 20*b*. As shown, the skirt section counterpart 20*a* is integrally connected to the water jacket outer wall 12A in such a manner that the water jacket outer wall 12A and the skirt section counterpart 20*a* are in generally straight alignment with each other at least an area near an imaginary connecting section C at which the both 12A, 20*a* seem to be integrally connected. The skirt section counterpart 20*b* is likewise integrally connected to the water jacket outer wall 12B. Accordingly, the cylinder block 10 is generally in the shape of isosceles trapezoid in cross-section taken along a vertical plane to which the axis of the cylinder block is perpendicular as shown in FIGS. 3 and 4, so that the distance between the skirt section opposite counterparts 20*a*, 20*b* is widened at the lower part of the skirt section 20 as compared with at the upper part of the skirt section 20. Consequently, the inner surface of the skirt section 20 is formed along the envelope X of the outer-most loci of the big end of a connecting rod (not shown), as illustrated in FIG. 3.

In order to obtain the necessary width of the water jacket (i.e., the distance between the outer wall surface of cylinder sections 16 and the inner surface of water jacket outer wall 12A, 12B) of at least 6 mm, the upper part of each water jacket outer wall 12A, 12B is formed into cylindrical shape and is parallel with the cylinder section 16 in the vicinity of an imaginary vertical plane (cross-sectional plane) 3—3 shown in the FIG. 2. However, in case where a sufficient width of each water jacket 18A, 18B can be obtained, it is desirable to so form the cylinder block 10 that the whole parts of each water jacket outer wall 12A, 12B including its upper part are in generally straight alignment with the skirt section counterpart 20*a*, 20*b*. The reference numeral 22 denotes main bearing caps a of which is secured to each hearing bulk or bearing support section 23 forming part of the cylinder block 10. The bearing bulk 13 is integral with the cylinder block 20. A cylindrical opening (no numeral) for rotatably supporting therein a crankshaft (no numeral) is defined between the bearing bulk 23 and the main bearing cap 22.

In operation with an internal combustion engine having the above-arranged cylinder block 10, when the explosion or combustion of air-fuel mixture is carried out in each combustion chamber formed between the cylinder head and the piston within the cylinder bore B, vibration is generated and propagated to various parts of the cylinder block 10 and, of course, to the skirt section 20. However, since the skirt section 20 is in straight alignment with the water jacket outer walls 12A, 12B so that the cross-sectional shape of the cylinder block 10 is of the isosceles trapezoid, the skirt section 20 is prevented from vibrating in the direction to widen the distance between the skirt section counterparts 20*a*, 20*b*, i.e. to move laterally each skirt section counterpart 20*a*, 20*b*. In this connection, in case of the conventional cylinder block shown in FIG. 1, when the same vibration is propagated, the skirt section 4 readily vibrates in the direction to widen the skirt section.

Furthermore, because of the isosceles trapezoid shape cylinder block 10, sufficient torsional and flexural rigidities can be obtained, thereby effectively suppressing the generation of vibration noises at the various parts of the cylinder block 10. Additionally, the generation of vibration noise from an oil pan 21 secured to the skirt section 20 can also be effectively suppressed. Due to the fact that the skirt section 20 is formed flat, the surface area of the skirt section 20 is considerably small as compared with the conventional bulged skirt section 4 as shown in FIG. 1, and therefore the natural frequency of the skirt section 20 increases, thereby greatly reducing the energy of noise radiated from the skirt section 20.

In this instance, as shown in FIG. 4, the cylinder block 10 is formed integrally with cylinder head installation boss sections 24 each of which has a hole 26 to which a cylinder head bolt (not shown) is inserted so as to secure a cylinder head (not shown) onto the top surface of the cylinder block 10. It is to be noted that each boss section 24 is further integrally connected through a rib 28 to the inner surface of the water jacket outer wall 12A, 12B. As a result, when the cylinder head is installed onto the cylinder block 10, the cylinder head acts as a stiffening member for improving the stiffness of the cylinder block 10, thereby effectively supressing the vibration of the cylinder block 10. Additionally, the skirt section 20 is formed at its bottom with a relatively wide flange 20*c* to which an oil pan 21 is secured, so that the flexural rigidity of the cylinder block 10 in its lateral direction can be considerably improved.

FIGS. 5 to 9 illustrate another embodiment of the cylinder block 10 in accordance with the present invention, which is similar to the embodiment of FIGS. 2 to 4 except that a bearing beam structure 30 is located in place of the main bearing caps 22 of the embodiment of FIGS. 2 to 4. The bearing beam structure 30 is composed of a plurality of bearing cap sections 32. Each bearing cap section 32 is formed with a semicylindrical bearing support recess 32*a*. The bearing cap sections 32 are integrally connected through a beam section 34 with each other. The beam section 34 extends along the axis of the crankshaft and is usually made by integrally casting the beam section 34 with the bearing cap sections 32. The bearing cap sections 32 of the bearing beam structure 30 are respectively secured to the bearing bulks 23 by means of bolts 35, in which a cylindrical opening for supporting the crankshaft is defined by a semicylindrical bearing support recess 23*a* of each bearing bulk 23 and the above-mentioned recess 32*a* of each bearing cap section 32. It will be understood that each bearing cap section 32 and the beam section 34 may be separately prepared as independent pieces, and thereafter securely connected with each other, for example, by means of bolts.

Figure 7:
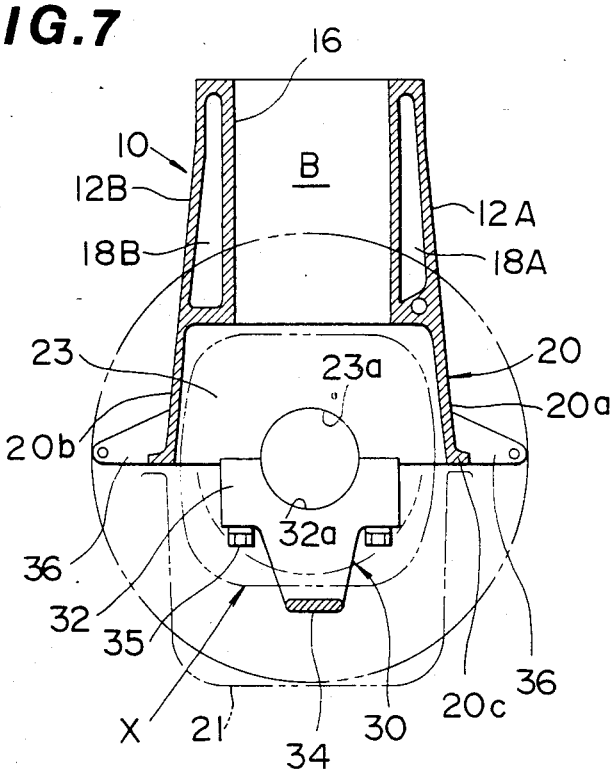
FIG. 7 is a vertical cross-sectional view taken in the direction of arrows substantially along the line 7—7 of FIG. 6.
Figure 8:
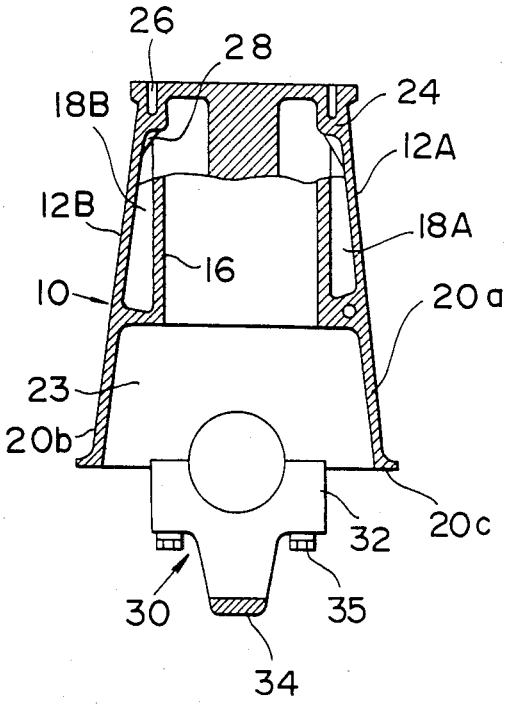
FIG. 8 is a vertical cross-sectional view taken in the direction of arrows substantially along the line 8—8 of FIG. 6.
Figure 9:
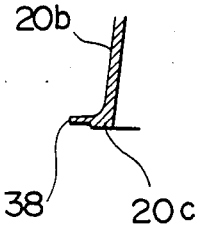
FIG. 9 is a fragmentary cross-sectional view showing another example of the cylinder block of FIG. 5.

As shown in FIG. 7, the cylinder block 10 is further integrally formed with a transmission installation section 36 to which a transmission T is securely connected. It will be understood that this transmission installation section 36 contributes to an improvement in the flexural rigidity of the cylinder block 10 in its lateral direction in addition to the wider oil pan installation flange 20*c*. In order to achieve a further improvement in the flexural rigidity of the cylinder head 10, a rib 38 may be formed integrally with and along the flange 20*c* of each skirt section counterpart 20*a*, 20*b* as shown in FIG. 9.

With the cylinder block arrangement of FIGS. 5 to 8, by virtue of bearing beam structure 30 installed at the bottom section of the cylinder block 10, a further improvement can be achieved particularly in flexural rigidity in the cylinder block vertical direction. Additionally, the bearing beam structure 30 can effectively suppress the vibration of the bearing cap section 32 in the direction that the bearing cap sections 32 come down, i.e., in the direction of the axis of the cylinder block 10. This reduces the vibration to be applied to the skirt section 20, thus further decreasing noise to be radiated from the skirt section 20. Such vibration reduction of the skirt section 20 contributes to the vibration reduction of the oil pan 21, thereby effectively decreasing noise to be radiated from the oil pan 21.

It will be understood that the cylinder block 10 itself is provided with a sufficient rigidity against flexure, torsion and the like applied thereto, and therefore it is unnecessary to take such rigidities into account in designing the bearing beam structure 30. In this regard, it is sufficient that the bearing structure 30 has a minimum dimension enough to suppress the above-mentioned coming-down vibration of the bearing cap sections 32. As a result, noise reduction can be very effectively achieved without noticeable engine weight increase.

Figure 10:
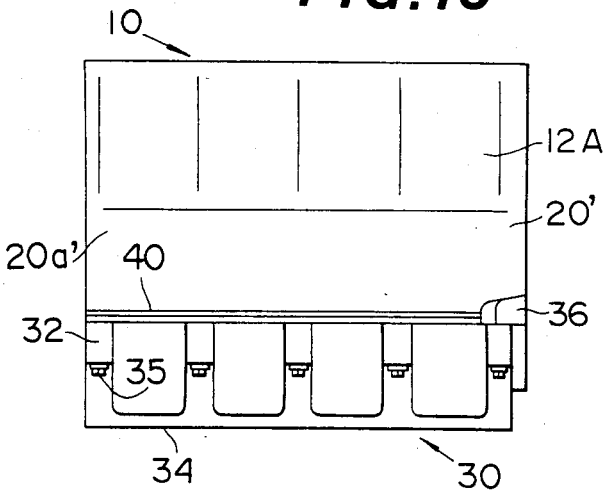
FIG. 10 is a side elevation of a further embodiment of the cylinder block equipped with a bearing beam structure, in accordance with the present invention.
Figure 11:
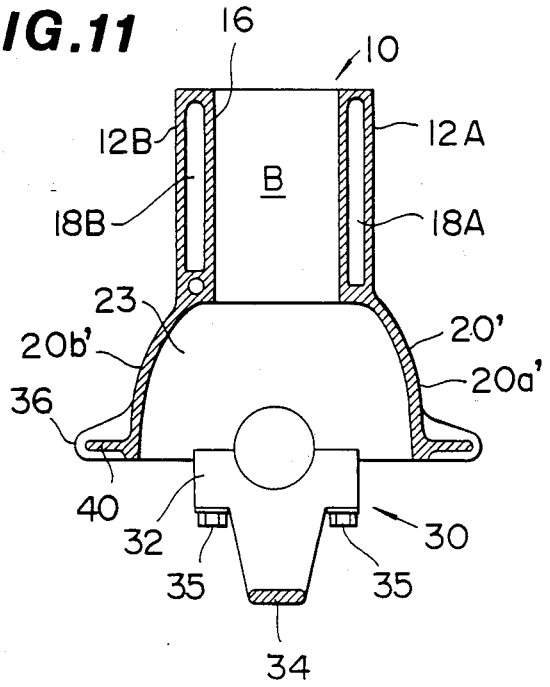
FIG. 11 is a vertical cross-sectional view of the cylinder block of FIG. 10.
Figure 12:
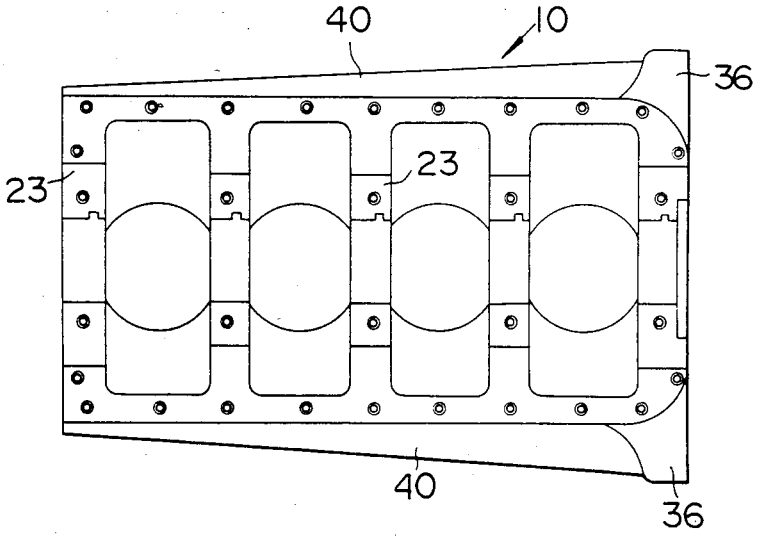
FIG. 12 is a bottom plan view of the cylinder block of FIG. 10.

FIGS. 10 to 12 illustrate a further embodiment of the cylinder block in accordance with the present invention, in which the skirt section 20' is curved at its surface or bulged outwardly. In this embodiment, each of the oppositely disposed walls 20*a'*, 20*b'* of the skirt section 20' is formed integrally at its outer surface with a flange-like reinforcement rib 40 which extends along the axis of the crankshaft or of the cylindrical opening for the crankshaft. The reinforcement rib 10 is located at the same level as the axis of the crankshaft and projects generally horizontally relative to the cylinder block 10. The reinforcement rib 40 extends along the axis of the crankshaft from the front end of the cylinder block 10 to the rear end of the same, so that the reinforcement rib 40 is integrally connected to the transmission installation section 36. In this instance, the reinforcement rib 40 is formed so that its thickness and width (projection width) gradually increase from the front end thereof toward the rear end thereof as shown in FIG. 12. This contributes to engine weight lightening, meeting such a requirement that the rear section of the cylinder block 10 should be great in weight and high in rigidity as compared with the front section thereof. In addition to the above, the cylinder block 10 of this instance is reinforced by employing the bearing beam structure 30 which is the same as in the embodiment of FIGS. 5 to 9.

With the above arrangement, the reinforcement rib 40 and the bearing beam structure 30 located at the side outer surface and bottom section of the cylinder block 10, respectively, act as reinforcement members for the cylinder block 10 to suppress various vibrations and deformations of the cylinder block 10. In other words, the bearing beam structure 30 is mainly effective against flexure in the upward an downward directions of the cylinder block 10, whereas the reinforcement rib 40 is mainly effective against flexure in the lateral directions of the cylinder block 10. Furthermore, the cooperation of the bearing beam structure 30 and the reinforcement rib 40 is effective against the torsion applied to the cylinder block 10. By virtue of the bearing beam structure 30, the vibration of the bearing cap sections 32 is effectively suppressed, which vibration may causes the bearing cap sections 32 to come down. This decreases the force to be applied to the skirt section 20. Additionally, the skirt section 20 is prevented from readily vibrating in the lateral direction to move the skirt section outwardly, under the action of the reinforcement rib 40. Thus, noise radiation from the skirt section 20 can be greatly decreased, under the above-mentioned rigidity improvement effect. This vibration reduction in the skirt section 20 contributes to the suppression of noise radiation from an oil pan.

In addition to the above, since the reinforcement rib 40 is continuously connected to the transmission installation section 36, the connection rigidity between the cylinder block 10 and the transmission is improved, thereby noticeably reducing low frequency noise generating within a passenger compartment, and extending the maximum critical engine speed.

Moreover, because of the reinforcement rib 40, the cylinder block itself has a sufficient rigidity against the flexure in the lateral direction, and therefore it is unnecessary to take such flexural rigidity into account in designing the beam section 34 of the bearing beam structure 30. Accordingly, it is sufficient that the beam section 34 of the bearing beam structure 30 has the minimum dimension necessary to suppress the above-mentioned coming-down vibration of the bearing cap sections 32. As a result, noise reduction can be effectively attained, achieving engine weight lightening.

It will be understood that the principle of the invention shown in FIGS. 10 to 12 may be applied to cylinder blocks which are not provided with a so-called upper deck, i.e., cylinder blocks whose water jackets formed in the cylinder block will communicate with an engine coolant passage formed in the cylinder head, in which the weight lightening advantage due to this type of cylinder block can be maintained.

What is claimed is:

1. A cylinder block having opposite ends comprising:

a skirt section having oppositely disposed first and second walls;

a transmission installation section to which a transmission is to be securely connected, said transmission installation section being located at one of said ends of the cylinder block; and noise and vibration reducing means comprising first and second reinforcement ribs which are respectively formed integrally with said skirt section first and second walls, each reinforcement rib being located on an outer surface of the respective skirt section wall and projecting outwardly, each reinforcement rib extending generally along the axis of a crankshaft and located generally at the same level as the crankshaft axis, each reinforcement rib having a first end connected to said transmission installation section and a second end located in a vicinity of the other end of the cylinder block, wherein each reinforcement rib has a lower surface spaced from a bottom surface of each skirt section wall and is located above a level of bottom surface of the skirt section and being free from any surface contact between the ends of each rib.

2. A cylinder block as claimed in claim 1, wherein each reinforcement rib has the shape of a flange.

3. A cylinder block as claimed in claim 2, wherein each reinforcement rib is formed so that its thickness and width gradually decrease from the one end toward the other end of said cylinder block.

4. A cylinder block as claimed in claim 1, further comprising a bearing beam structure including a plurality of bearing cap sections, each of which is secured to a bearing support section integral with said skirt section, said crankshaft being rotatably supported by each bearing support section and each bearing cap section being secured to each other and also to a beam section which securely connects said plurality of bearing cap sections with each other, said beam section extending along the axis of said crankshaft.

5. A cylinder block as claimed in claim 4, wherein said beam section is integral with said plurality of bearing cap sections.

* * * * *